United States Patent [19]

Iizumi et al.

[11] Patent Number: 4,959,627

[45] Date of Patent: Sep. 25, 1990

[54] ELECTROMAGNET RELAY

[75] Inventors: Makoto Iizumi; Tatsumi Ide; Noboru Kanzawa; Akira Sekiguchi; Masayuki Morimoto; Hitoshi Goto; Tsutomu Ono, all of Tokyo, Japan

[73] Assignee: NEC Corporation, Japan

[21] Appl. No.: 284,908

[22] Filed: Dec. 15, 1988

[30] Foreign Application Priority Data

| | | | |
|---|---|---|---|
| Dec. 23, 1987 | [JP] | Japan | 62-328153 |
| Mar. 31, 1988 | [JP] | Japan | 63-41962 |
| Jun. 30, 1988 | [JP] | Japan | 63-85875 |

[51] Int. Cl.[5] ..... H01H 67/00

[52] U.S. Cl. ..... 335/106; 335/159; 335/128

[58] Field of Search ..... 335/78–85, 335/104, 105, 106, 124, 128, 133, 134, 135, 136, 159, 160, 161, 162, 163, 202

[56] References Cited

U.S. PATENT DOCUMENTS 3,978,440 8/1976 Prouty et al. ..... 335/136

*Primary Examiner*—Leo P. Picard
*Assistant Examiner*—Lincoln Donovan
*Attorney, Agent, or Firm*—Laff, Whitesel, Conte & Saret

[57] ABSTRACT

An electromagnetic relay includes a flat base made of an insulating material, two flexure type electromagnetic relay blocks fixed on the base so as to be point symmetrical with the center of the base and having the same structure, a first contact member including two make contacts respectively opposing the movable contacts of the two electromagnetic relay blocks and at least one first terminal inserted into a first through hole formed in a central portion of the base, and a second contact member including two break contacts respectively opposing the movable contacts of the two electromagnetic relay blocks and at least one second terminal inserted into a second through hole formed in a central portion of the base.

10 Claims, 10 Drawing Sheets

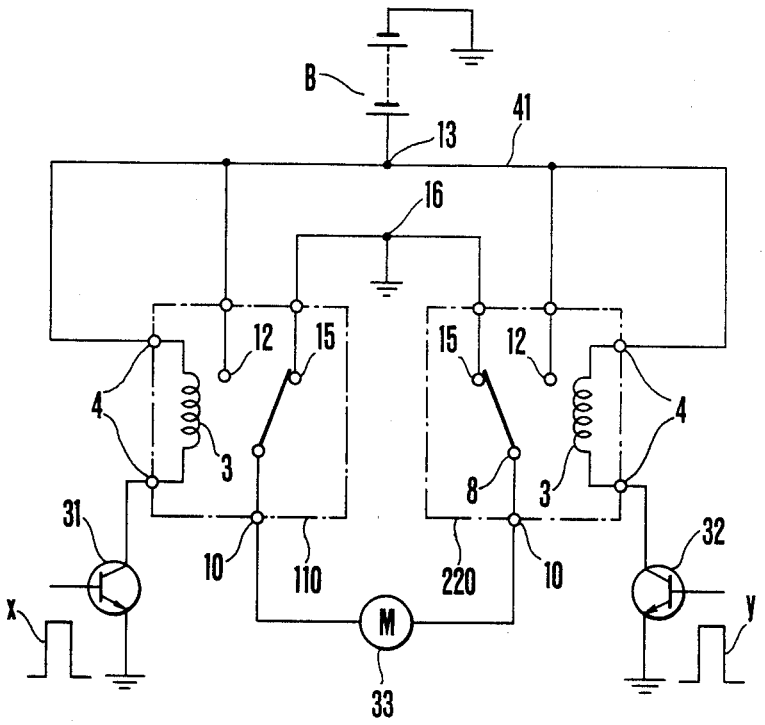
FIG.4
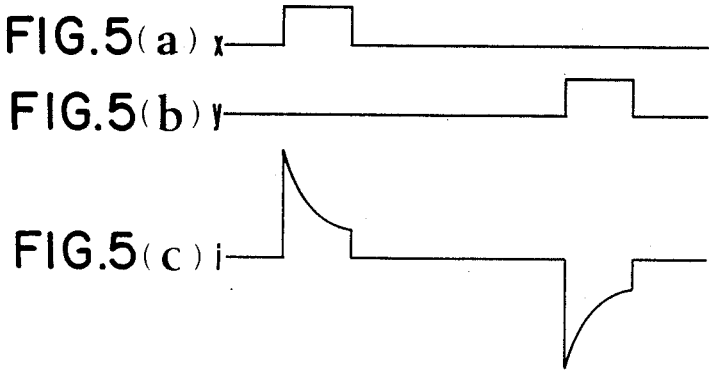

ELECTROMAGNET RELAY

BACKGROUND OF THE INVENTION

The present invention relates to an electromagnetic relay and, more particularly, to an electromagnetic relay suitable for an electric circuit such as a vehicle electric circuit.

As vehicle electric devices and the like have increasingly become sophisticated, electromagnetic relays have been widely used for controlling forward/reverse rotation of the armature of a motor or forward/reverse operation of a plunger of a solenoid. In order to perform the above-described function, at least two electromagnetic relays are used in such an electric device. It is required that each electromagnetic relay has a small size and does not need a large mounting space, and that the number of electromagnetic relay components is small and assembly and adjustment can be easily performed.

U.S. Pat. No. 4,686,500 discloses an electromagnetic relay aiming at a miniature construction. Japanese Patent Laid-Open No. 51-24748 discloses a relay device wherein the moving direction of a movable contact of an electromagnetic relay is parallel to the surface of a base. In addition, Japanese Patent Laid-Open No. 56-134434 discloses a relay device using two magnetic relays.

A conventional relay device using two magnetic relays requires a large number of components, and has a structure in which coils tend to be damaged or disconnected in working on end portions of the coils. In addition, since components must be assembled in three directions, assembly becomes complicated. Moreover, adjustment of a contact force of each contact upon completion of assembly is difficult.

SUMMARY OF THE INVENTION

It is an object of the present invention to provide a small electromagnetic relay which can eliminate the above drawbacks and facilitate working on of end portions of coils, and assembly and adjustment of contact force.

According to the present invention, there is provided an electromagnetic relay comprising a flat base made of an insulating material, two flexure type electromagnetic relay blocks fixed on the base so as to be point symmetrical with a center of the base and having the same structure, each of the flexure type electromagnetic relay blocks including an iron core having a coil wound therearound, a yoke fixed to one end of the iron core, an armature which opposes the other end of the iron core and is attracted to the iron core excited upon energization of the coil, a hinge spring for supporting movement of the armature, and a leaf spring having a movable contact and interlocked with the armature, a moving direction of the leaf spring being parallel to a surface of the base, a first contact member including two make contacts respectively opposing the movable contacts of the two electromagnetic relay blocks and at least one first terminal inserted into a first through hole formed in a central portion of the base, and a second contact member including two break contacts respectively opposing the movable contacts of the two electromagnetic relay blocks and at least one second terminal inserted into a second through hole formed in a central portion of the base.

BRIEF DESCRIPTION OF THE DRAWINGS

FIGS. 4 and FIGS. 5(*a*) to 5(*c*) are a circuit diagram and timing charts, respectively, showing a case wherein the embodiment in FIG. 1 is applied;

DETAILED DESCRIPTION OF THE PREFERRED EMBODIMENTS

The present invention will be described below with reference to the accompanying drawings.

Figure 1:
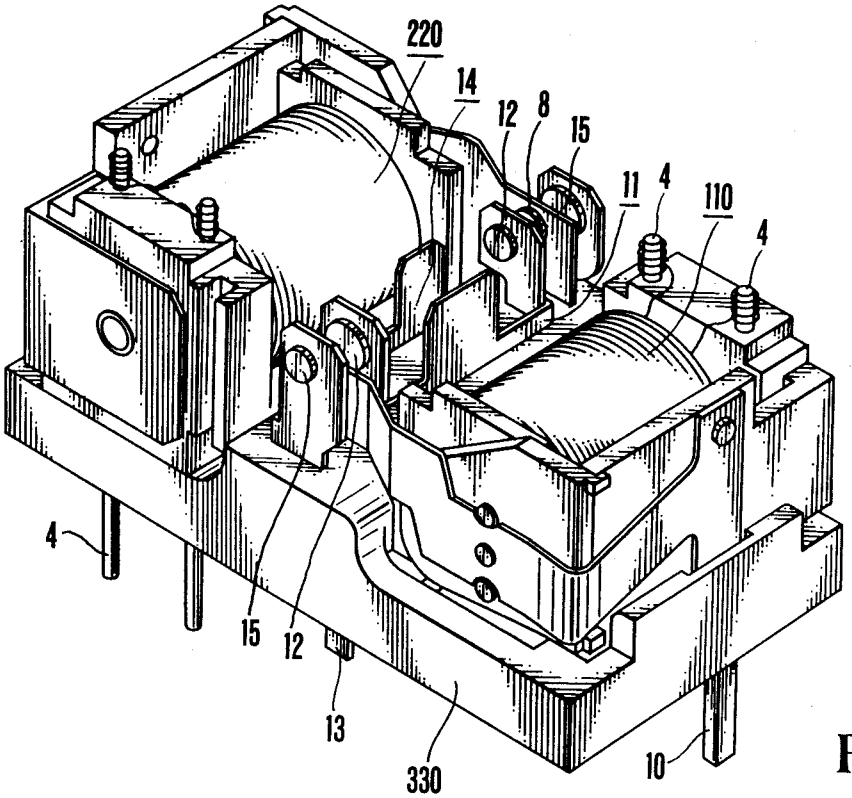
FIGS. 1 and 2 are a perspective view and an exploded perspective view, respectively, showing an embodiment of the present invention.
Figure 2:
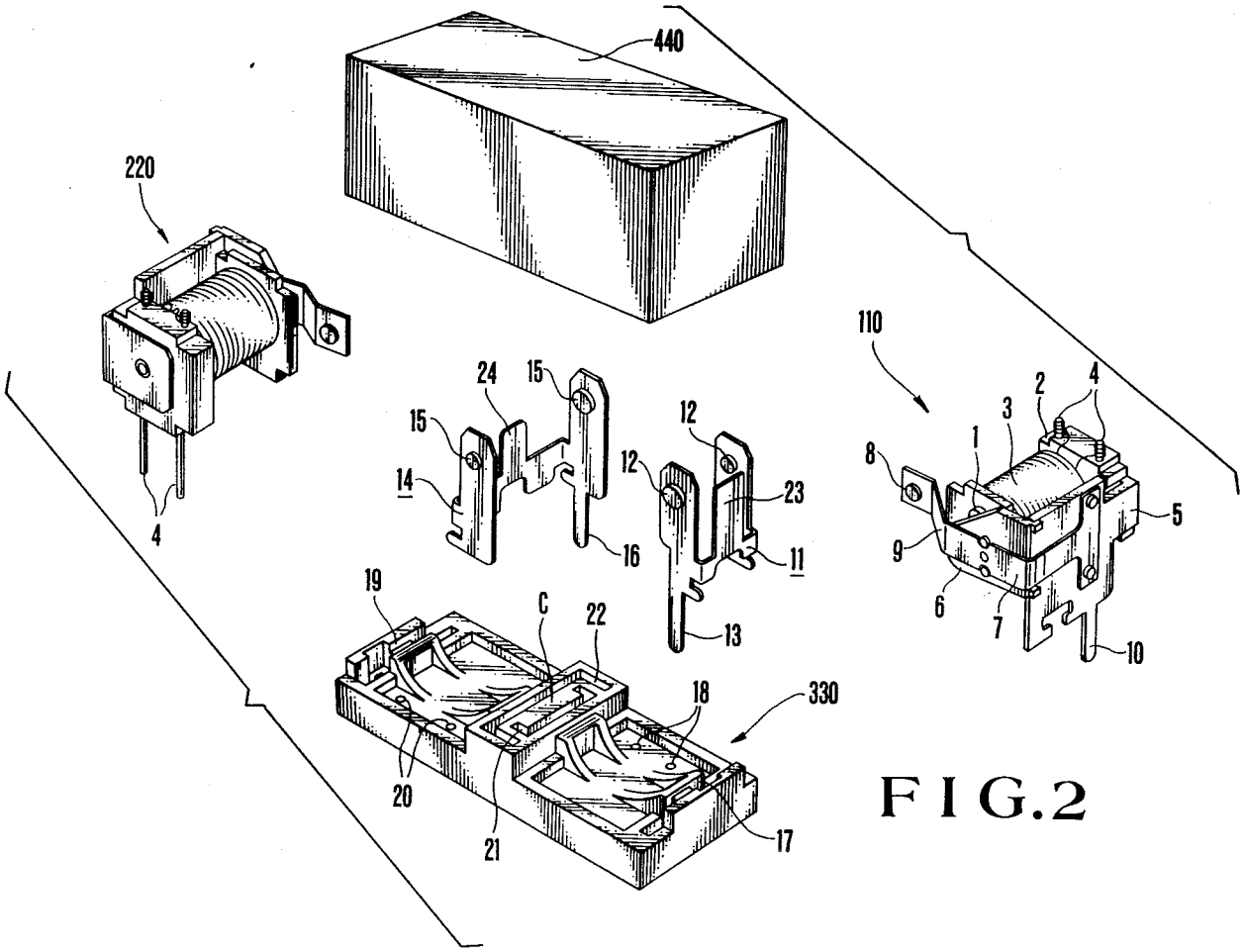

FIG. 1 is a perspective view showing an electromagnetic relay without a cover according to an embodiment the present invention. FIG. 2 is an exploded perspective view of the electromagnetic relay.

Referring to FIGS. 1 and 2, reference numerals 110 and 220 denote flexure type electromagnetic relay blocks having identical structures, which are arranged on a flat base 330 made of an electrically insulating member so as to be point symmetrical with the center C of the base 330.

Each of the electromagnetic relay blocks 110 and 220 comprises a spool 2 incorporating an iron core 1 and having a coil 3 wound therearound, terminals 4 for leading a pair of coils outward, a yoke 5 mechanically and magnetically coupled to one end of the iron core 1, an armature 6, a substantially L-shaped or arcuated hinge spring 7 mechanically coupled to the armature 6 with a rivet or the like, mechanically and magnetically coupling one end of the yoke 5 and the armature 6 and having an electrically conductive function, a leaf spring 9 which is integrally formed with the hinge spring 7 with a single spring member and has a movable contact 8, and a terminal 10 which extends from the yoke 5 toward the base 330 and is electrically connected with the movable contact 8. The terminal 10 may extend from the spring member.

Reference numeral 11 denotes a contact member which is constituted by a substantially U-shaped conductive member, and includes a pair of make contacts 12 attached to both the end portions of the U-shaped member, at least one terminal 13 extending toward the base 330, and a flat heat sink 23 formed at a central portion of the contact member.

Reference numeral 14 denotes a contact member which is constituted by a U-shaped conductive member having a larger width than the contact member 11, and includes a pair of break contacts 15 attached to both the end portions of the U-shaped member, a terminal 16 extending toward the base 330, and a flat heat sink 24.

The base 330 comprises a groove 17 having a through hole for receiving the terminal 10 of the electromagnetic relay block 110 therein and through holes 18 for receiving the terminals 4 of the electromagnetic relay block 110 therein, a groove 19 having a through hole for receiving the terminal 10 of the electromagnetic relay block 220 therein and through holes 20 for receiving the terminals 4 of the electromagnetic relay block 220 therein, the groove 19 and the through holes 20 being formed at position point symmetrical with the groove 17 and the through holes 18 about the center C of the base, respectively, a U-shaped groove 21 having a through hole for receiving the terminals 13 of the contact member 11 therein and a U-shaped groove 22 having a larger width than the groove 21 and a through hole for receiving the terminal 16 of the contact member 14 therein.

In assembly, the electromagnetic relay block 110 is fixed to the base 330 by inserting the terminals 10 and 4 thereof into the through hole of the groove 17 and the through holes 18 from top to bottom, respectively. The electromagnetic relay block 220 is fixed to the base 330 by inserting the terminals 10 and 4 thereof into the through hole of the groove 19 and the through holes 20 from top to bottom, respectively. The contact members 11 and 14 are fixed to the base 330 by inserting the terminals 13 and 16 thereof into the through holes of the U-shaped grooves 21 and 22 from top to bottom, respectively.

Since all the magnetic relay blocks 110 and 220, and the contact members 11 and 14 are mounted on the base 330 in the same direction, i.e., from top to bottom in FIG. 2, the assembly can be facilitated.

In addition, since portions near the make and break contacts 12 and 15 are free ends, adjustment of a contact force at each contact, which is an important factor for the service life of a contact, can be easily performed by slightly bending these free ends.

FIG. 1 shows a state wherein the electromagnetic relay blocks 110 and 220, and the contact members 11 and 14 are fixed on the base 330. The assembly state shown in FIG. 1 may be considered as a finished product. However, a cover 440 may be mounted on the base 330, and the opening of the cover 440 and the base 330 may be airtightly fixed to each other by using a sealing agent, thereby obtaining an airtight structure.

Figure 3:
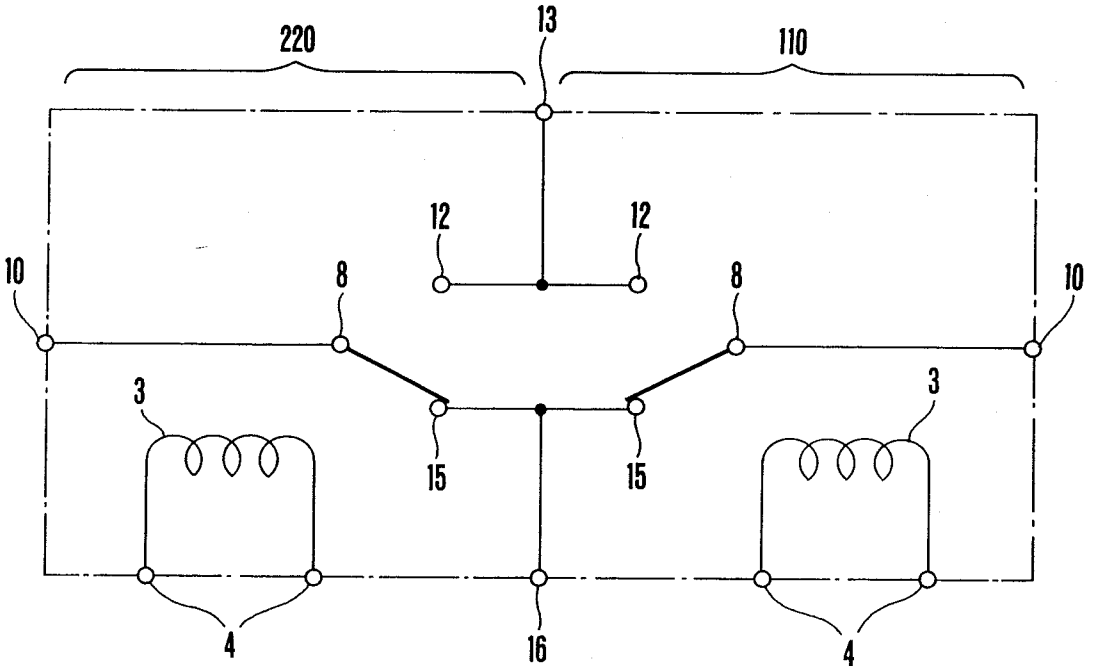
FIG. 3 is a circuit diagram of the embodiment in FIG. 1.

FIG. 3 shows an equivalent circuit diagram of an electromagnetic relay assembled in the above-described manner. In each of the electromagnetic relay blocks 110 and 220, during a deenergization period of the coil 3, the movable contact 8 is in contact with the break contact 15 due to elastic support by the hinge spring 7. When the coil 3 is energized and the iron core 1 is excited, the armature 6 is attracted to one end of the core 1. Upon this movement, the movable contact 8 is separated from the break contact 15 and is brought into contact with the make contact 12.

Since the make contacts 12 of the two electromagnetic relay blocks 110 and 220 are attached to the single contact member 11, and the respective break contacts 15 are attached to the single contact member 14, the external terminals of the two blocks 110 and 220 need not be connected to each other unlike the conventional magnetic relay using two electromagnetic blocks. Therefore, a space for connection of the external terminals can be reduced, assembly can be facilitated, and disconnection can be prevented. In addition, since the cover 440 and the base 330 are common to the electromagnetic relay blocks 110 and 220, the number of components can be decreased.

FIG. 4 and FIGS. 5(*a*) to 5(*c*) are a circuit diagram and timing charts for explaining an electromagnetic relay to which the above-described embodiment is applied.

When a driving current is supplied from a transistor 31, which is turned on by a driving pulse x (FIG. 5(*a*)), to the excitation coil 3 of the electromagnetic relay block 110, and the block 110 is driven, a current i (FIG. 5(*c*)) is flowed from a battery B to the contact 12 of the block 110 and the contact 15 of the electromagnetic relay block 220 to be supplied to a motor 33 in a single direction so as to rotate it in one direction for a desired period of time, and is released. When the block 220 is driven by a driving pulse y (FIG. 5(*b*)), the current i, which is flowed through the motor 33, is reversed so as to rotate the motor 33 in the reverse direction.

Figure 6:
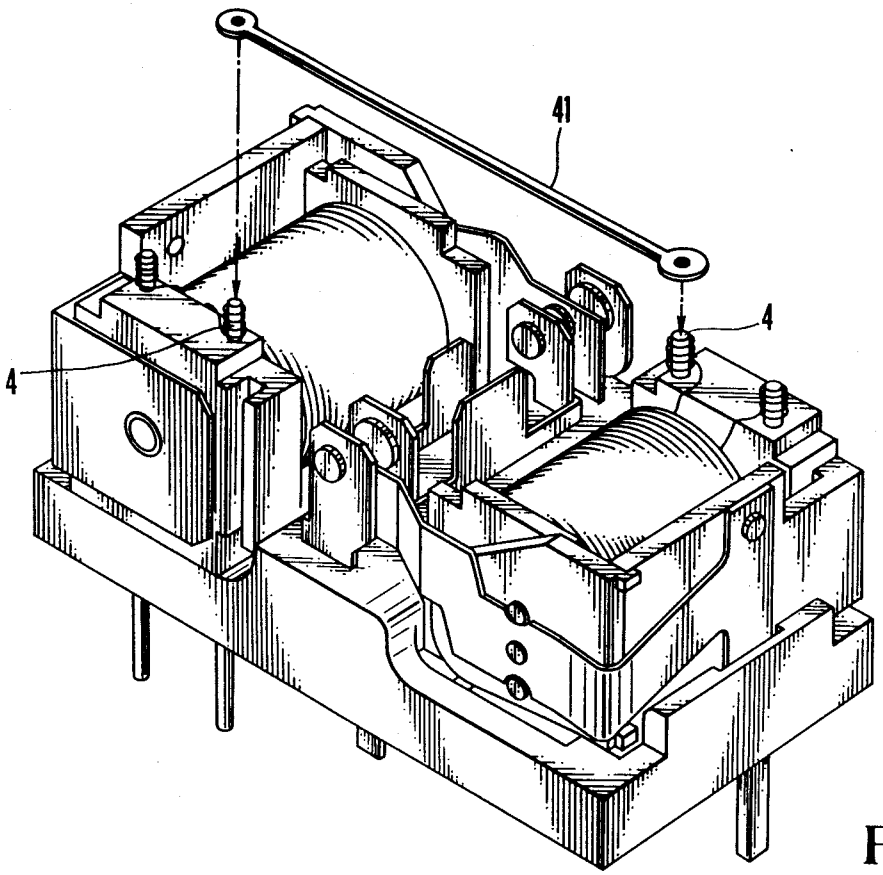
FIG. 6 is a perspective view showing another embodiment of the present invention.

FIG. 6 shows another arrangement of the above electromagnetic relay, wherein the terminals 4 of the two electromagnetic relay blocks 110 and 220, which are commonly connected to the battery B, are electrically connected to each other through a conductive member 41 above the base 330.

As described above, according to the present invention, a pair of electromagnetic relay blocks are arranged on a base so as to be point symmetrical with the center thereof, and make and break contact terminal members are respectively formed integrally. Therefore, in comparison with the conventional technique using two flexure type electromagnetic relays, the present invention has, for example, the following advantages: (1) a small electromagnetic relay occupying a small area can be obtained, (2) assembly can be facilitated because the respective components can be mounted on the base in the same direction, (3) adjustment of a contact force at each contact can be facilitated, (4) manufacturing efficiency and yield can be increased because electromagnetic relay blocks having the same structure are arranged so as to be point symmetrical, and (5) a low-cost electromagnetic relay can be provided because the number of components, such as a cover and base, can be deceased.

Heat dissipation is one of the problems posed in an electromagnetic relay.

If contacts through which a large current is flowed are disconnected, an arc may be generated between the contacts. Generally, such an arc accompanies a high temperature as high as several thousands to several ten thousands degrees. Therefore, even an instantaneous arc can quickly heat the contacts, and greatly decreases their service lives. For this reason, heat sinks 23 and 24 are respectively provided to the contact members 11 and 14 shown in FIG. 2.

Figure 7:
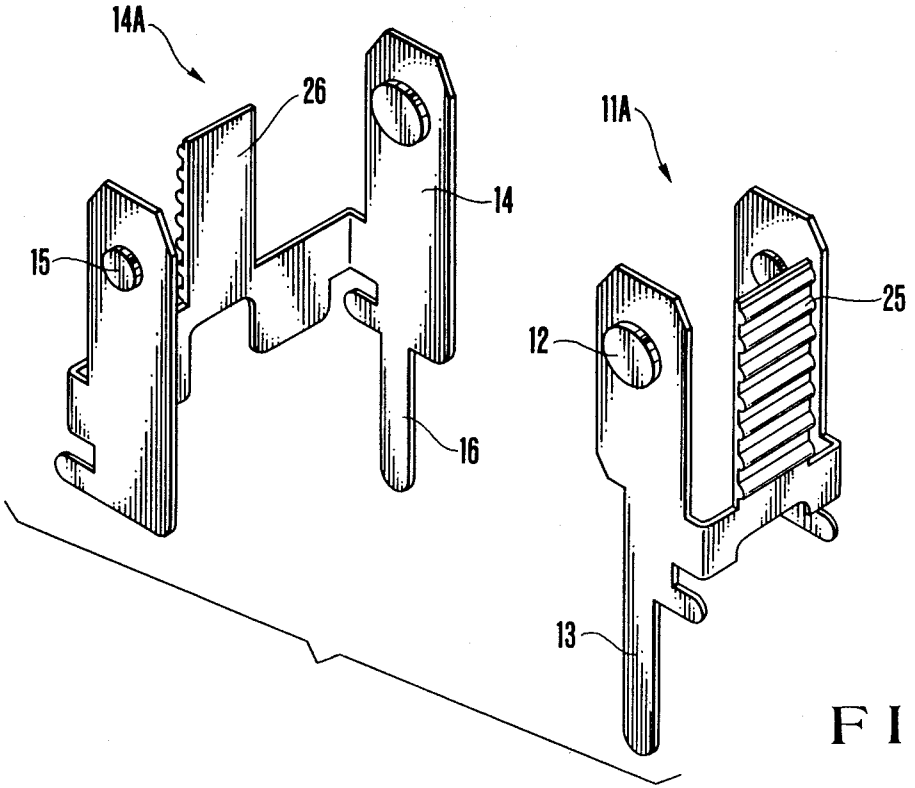
FIG. 7 is a perspective view showing another arrangement of a heat sink shown in FIG. 1.

FIG. 7 shows another arrangement which aims at improving the function, of the heat sinks shown in FIG. 2, for dissipating heat of the contact members.

Referring to FIG. 7, contact members 11A and 14A are the same as the contact members 11 and 14 shown in FIG. 2 except for the shape of each heat sink. The contact members 11A and 14A comprise heat sinks 25 and 26 each having fins, respectively.

By forming fins on the heat sinks 25 and 26 in this manner, heat can be dissipated with great efficiency. As a result, heat generated between contacts can be quickly cooled down so that the service life of each contact can be greatly prolonged, and the consumption of each contact with respect to the same load can be decreased.

In addition, the size of the electromagnetic relay can be reduced, and the strength of each contact member can be increased.

In FIG. 7, the fins are formed only on one surface of each contact member. However, if fins are formed on both the surfaces of each contact member, the heat dissipation effect can be further enhanced.

Figure 8A:
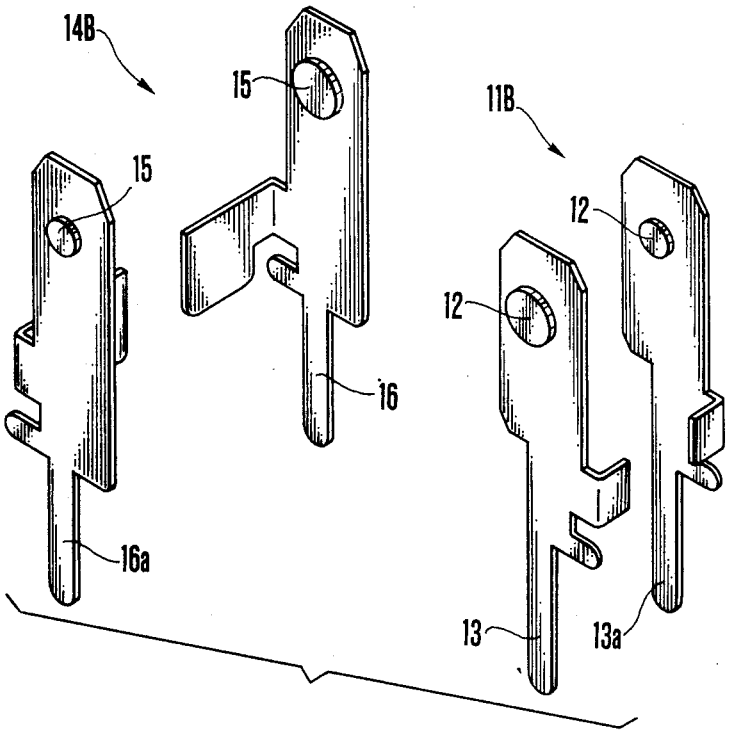
FIGS. 8A, 9A, and 10A are perspective views each showing another arrangement of contact members shown in FIG. 1.
Figure 9A:
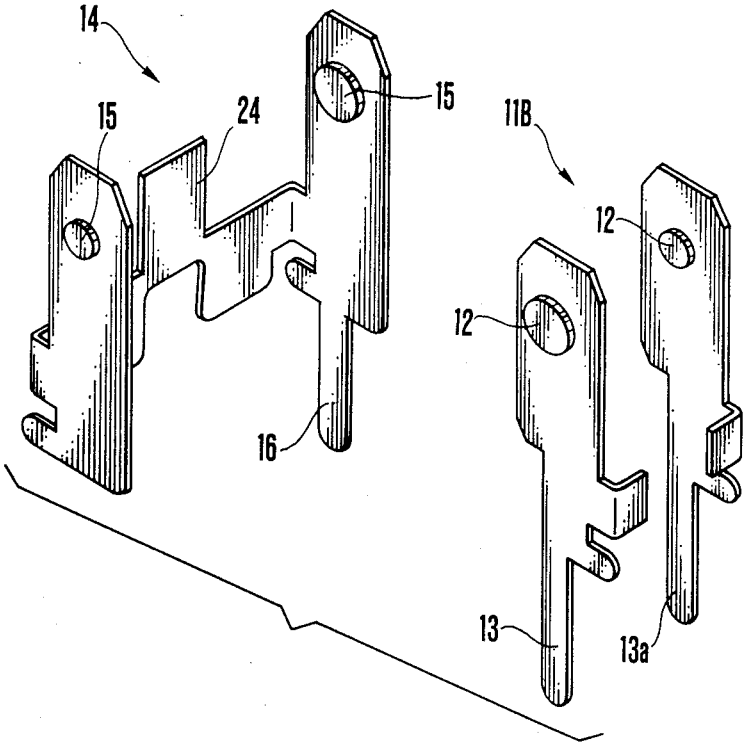
Figure 10A:
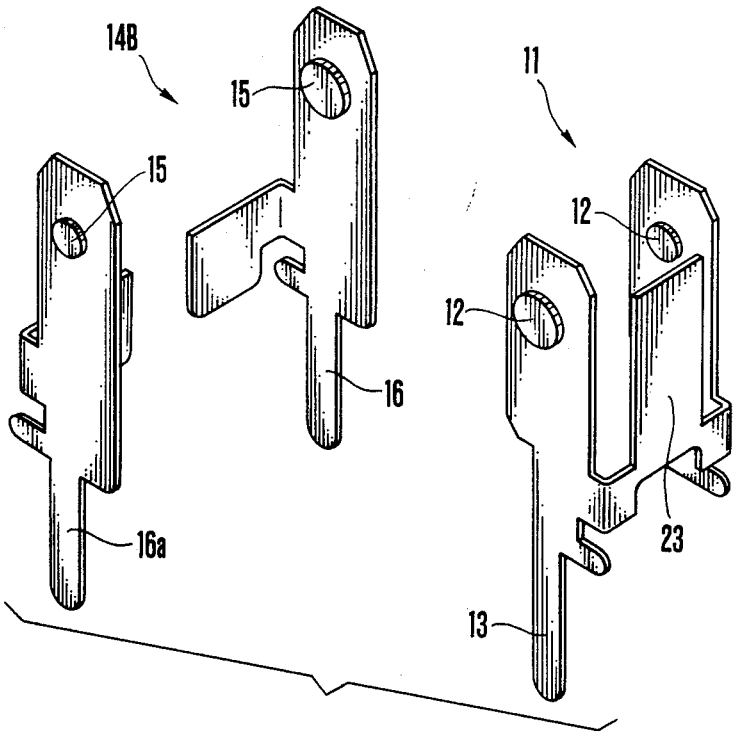

FIGS. 8A, 9A, and 10A show other arrangements of the contact members, respectively. The same reference numerals in FIGS. 8A, 9A, and 10A denote the same parts as in FIG. 2.

Referring to FIG. 8A, a make contact member 11B has no central portion, that is, is separated into two parts and has no heat sink. An output terminal 13a is added to the member 11B. A break contact member 14B has no central portion, that is, is separated into two parts and has no heat sink. An output terminal 16a is added to the member 14B.

Figure 8B:
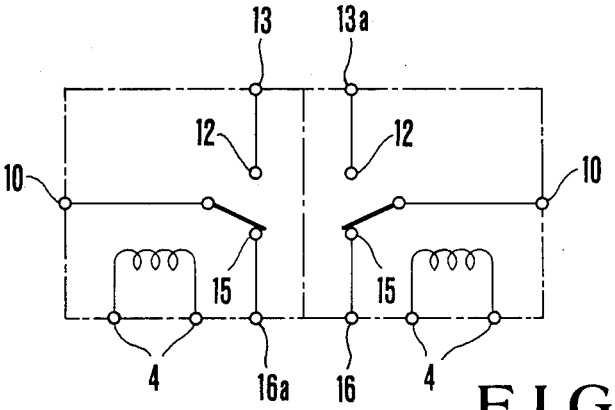
FIGS. 8B, and 10B are circuit diagrams of electromagnetic relays respectively using the contact members in FIGS. 8A, 9A, and 10A.

FIG. 8B shows a circuit diagram of an electromagnetic relay using the contact members 11B and 14B shown in FIG. 8A. As shown in FIG. 8B, two independent relay units can be housed in a signal case.

FIG. 9A shows an arrangement obtained by combining the make contact member 11B having no central portion and no heat sink shown in FIG. 8A with the break contact member 14 having the heat sink 24 shown in FIG. 2.

Figure 9B:
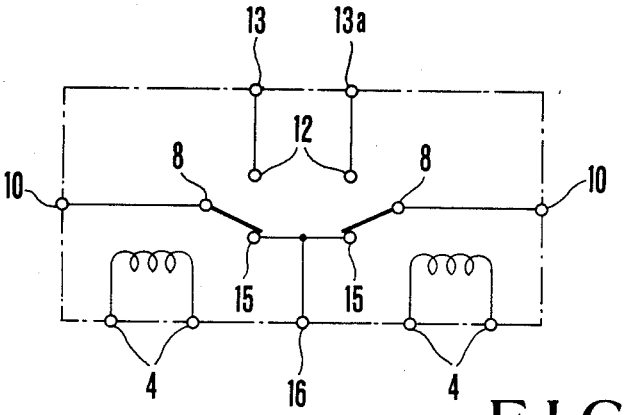

FIG. 9B is a circuit diagram of an electromagnetic relay using the contact members 11B and 14 shown in FIG. 9A.

FIG. 10A shows another arrangement obtained by combining the make contact member 11 having the heat sink 23 shown in FIG. 2 with the break contact member 14B having no heat sink shown in FIG. 8A.

Figure 10B:
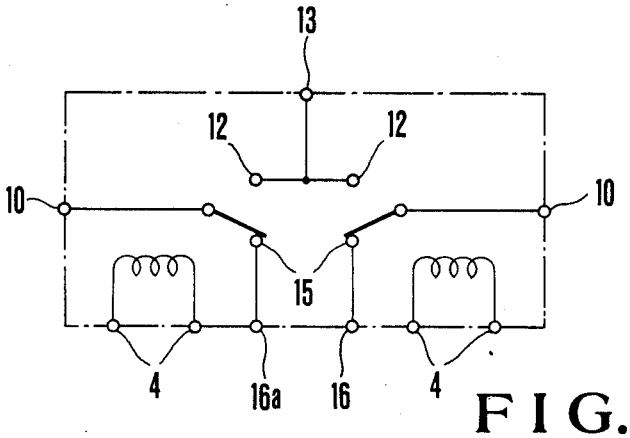

FIG. 10B is a circuit diagram of an electromagnetic relay using the contact members 11 and 14B shown in FIG. 10A.

As described above, various circuit variations can be made by modifying the contact members.

Figure 11:
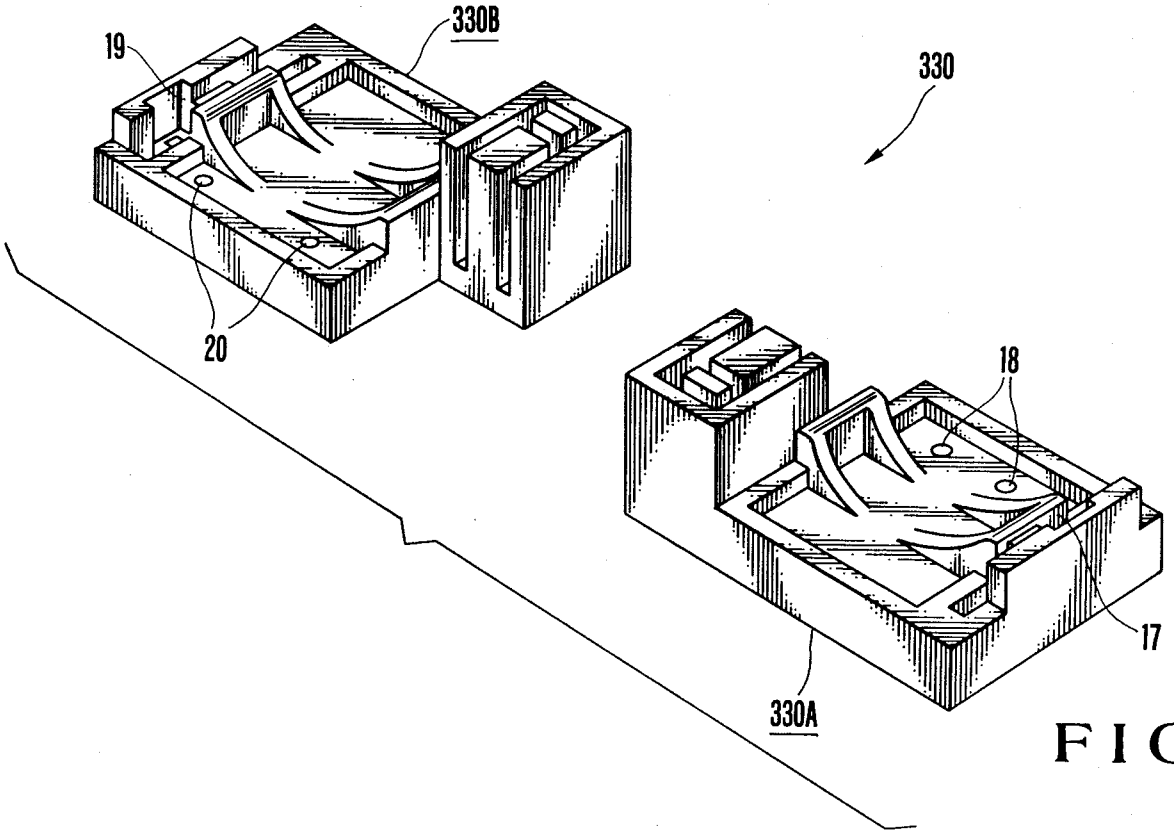
FIG. 11 is a perspective view showing another arrangement of a base shown in FIG. 1.

FIG. 11 shows another arrangement of the base 330.

Referring to FIG. 11, a base 330 is designed such that base blocks 330A and 330B having the same structure, in which a half of a contact member mounting portion is attached to a portion at which an electromagnetic relay block is mounted, are combined so as to be point symmetrical.

When the base blocks 330A and 330B are combined, U-shaped grooves respectively corresponding to the grooves 21 and 22 shown in FIG. 2 are formed.

Since the base blocks 330A and 330B are small in size, the number of blocks obtained by molding can be increased. When a defect is found in a die, the yield in this case can be decreased as well.

In addition, if one base block and one electromagnetic relay block are used with the contact member shown in FIG. 8A and a cover which is matched with the shape of the base block, an electromagnetic relay having a pair of internal contacts can be manufactured, and hence a series-connected electromagnetic relays can be easily manufactured.

What is claimed is:

1. An electromagnetic relay comprising:

a flat base made of an insulating material;

two flexure type electromagentic relay blocks fixed on said base so as to be point symmetrical with the center of said base and having the same structure, each of said flexure type electromagnetic relay blocks including an iron core having a coil wound therearound, a yoke fixed to one end of said iron core, an armature which opposes the other end of said iron core and is attracted to said iron core excited upon energization of said coil, a hinged spring for supporting movement of said armature, and a leaf spring having a movable contact and interlocked with said armature, a moving direction of said leaf spring being parallel to a surface of said base;

a first contact member made of a substantial U-shaped conductive member and including two make contacts respectively opposing said movable contacts of said two electromagnetic relay blocks and at least one first terminal inserted into a first through hole formed in a central portion of said base; and a second contact member made of a substantially U-shaped conductive member and including two break contacts respectively opposing said movable contacts of said two electromagnetic relay blocks and at least one second terminal inserted into a second through hole formed in a central portion of said base;

said first and second contact members having four fixed contacts which are aligned at a center area of the base, the two make contacts of the first contact member being positioned inside the two break contacts of the second contact member;

and each of the leaf springs being moved to become closer to each other when each of the relay block is driven.

2. A relay according to claim 1, wherein each of said first and second contact members comprise flat heat sinks.

3. A relay according to claim 2, wherein said heat sink includes fins.

4. A relay according to claim 1, wherein said first contact member is separated into two parts, and each part includes said first terminal inserted into said base.

5. A relay according to claim 1, wherein said second contact member is separated into two parts, and each part includes said second terminal inserted into said base.

6. A relay according to claim 1, wherein said base is designed such that two base blocks, which have the same structure constituted by a portion to which said electromagnetic relay block is fixed and a half of a portion to which said first and second contact members are fixed, are combined so as to be point symmetrical.

7. A relay according to claim 1, wherein one ends of said coils of said two electromagnetic relay blocks are connected to each other through a conductive member.

8. An electromagentic relay comprising:

a flat base made of an insulating material;

two flexure type electromagnetic relay blocks fixed on said base so as to be point symmetrical with the center of said base and having the same structure, each of said flexure type electromagnetic relay blocks including an iron core having a coil wound therearound, a yoke fixed to one end of said iron core, an armature which opposes the other end of said iron core and is attracted to said iron core excited upon energization of said coil, a hinged spring for supporting movement of said armature, and a leaf spring having a movable contact and interlocked with said armature, a moving direction of said leaf spring being parallel to a surface of said base;

a first contact member including two make contacts respectively opposing said movable contacts of said two electromagnetic relay blocks and at least one first terminal inserted into a first through hole formed in a central portion of said base; and a second contact member including two break contacts respectively opposing said movable contacts of said two electromagnetic relay blocks and at least one second terminal inserted into a second through hold formed in a central portion of said base;

each of said first and second contact members being flat heat sinks.

9. A relay according to claim 8, wherein said heat sinks include fins.

10. An electromagentic relay comprising:

a flat base made of an insulating material;

two flexure type electromagentic relay blocks fixed on said base so as to be point symmetrical with the center of said base and having the same structure, each of said flexure type electromagnetic relay blocks including an iron core having a coil wound therearound, a yoke fixed to one end of said iron core, an armature which opposes the other end of said iron core and is attracted to said iron core excited upon energization of said coil, a hinged spring for supporting movement of said armature, and a leaf spring having a movable contact and interlocked with said armature, a moving direction of said leaf spring being parallel to a surface of said base;

a first contact member including two make contacts respectively opposing said movable contacts of said two electromagnetic relay blocks and at least one first terminal inserted into a first through hole formed in a central portion of said base; and a second contact member including two break contacts respectively opposing said movable contacts of said two electromagnetic relay blocks and at least one second terminal inserted into a second through hold formed in a central portion of said base;

said base being designed such that two base blocks have the same structure, said base blocks being constituted by a portion to which said electromagnetic relay block is fixed and a half of a portion to which said first and second contact members are fixed, said base blocks being combined so as to be point symmetrical.

* * * * *